US007371715B2

(12) United States Patent
Yui et al.

(10) Patent No.: US 7,371,715 B2
(45) Date of Patent: May 13, 2008

(54) EMULSION COMPOSITION

(75) Inventors: Koji Yui, Wakayama (JP); Osamu Takiguchi, Wakayama (JP); Masakazu Sase, Wakayama (JP); Toshio Miyake, Wakayama (JP)

(73) Assignee: Kao Corporation, Tokyo (JP)

( * ) Notice: Subject to any disclaimer, the term of this patent is extended or adjusted under 35 U.S.C. 154(b) by 517 days.

(21) Appl. No.: 10/790,061

(22) Filed: Mar. 2, 2004

(65) Prior Publication Data

US 2004/0198902 A1 Oct. 7, 2004

(30) Foreign Application Priority Data

Mar. 3, 2003 (JP) ..... 2003-055716
Mar. 3, 2003 (JP) ..... 2003-055717

(51) Int. Cl.
*C11D 3/37* (2006.01)
*C11D 17/08* (2006.01)

(52) U.S. Cl. ..... 510/418; 524/504; 524/505; 524/800; 510/434

(58) Field of Classification Search ..... 524/504, 524/508, 800; 510/434, 418
See application file for complete search history.

(56) References Cited

U.S. PATENT DOCUMENTS

| | | | | |
|---|---|---|---|---|
| 3,328,309 | A * | 6/1967 | Grifo et al. | 510/417 |
| 5,776,882 | A | 7/1998 | Vasudevan | |
| 5,776,883 | A * | 7/1998 | Vasudevan | 510/470 |
| 6,291,418 | B1 | 9/2001 | Mertens et al. | |
| 7,105,477 | B2 * | 9/2006 | Takiguchi et al. | 510/418 |

FOREIGN PATENT DOCUMENTS

| | | | |
|---|---|---|---|
| EP | 0381431 | A2 | 8/1990 |
| EP | 0623670 | A2 | 11/1994 |
| EP | 0 798 372 | A1 * | 10/1997 |
| EP | 0953631 | A1 | 11/1999 |
| EP | 1162255 | A2 | 12/2001 |
| JP | 5-209198 | A | 8/1993 |
| JP | 7-37635 | B2 | 4/1995 |
| JP | 10-168493 | A | 6/1998 |
| JP | 11-181587 | A | 7/1999 |

OTHER PUBLICATIONS

English language abstract for Japanese patent document 11181587 (Jul. 6, 1999).
English language translation of JP 11-181587 A.

* cited by examiner

*Primary Examiner*—Tae H Yoon
(74) *Attorney, Agent, or Firm*—Birch, Stewart, Kolasch & Birch, LLP

(57) ABSTRACT

The invention relates to an emulsion composition, wherein an optically isotropic surfactant phase containing a nonionic surfactant (hereinafter the phase being referred to as the surfactant phase) is present as stable droplets in an aqueous solution phase containing an electrolytic salt (hereinafter the phase being referred to as the aqueous solution phase), the amount of the salt being such an amount that the aqueous solution phase is incompatible with the surfactant phase, with a polymer including a segment (a) having affinity with the aqueous solution phase and a segment (b) having affinity with the surfactant phase; and a liquid detergent composition containing the emulsion composition and inorganic builder particles dispersed in the emulsion composition.

19 Claims, 1 Drawing Sheet

EMULSION COMPOSITION

This Nonprovisional application claims priority under 35 U.S.C. § 119(a) on Patent Application Ser. No(s) . 2003-055716 and 2003-055717 filed in Japan on Mar. 3, 2003, the entire contents of which are hereby incorporated by reference.

FIELD OF THE INVENTION

The present invention relates to an emulsion composition of water, a surfactant and an electrolytic salt, which is useful in various fields of washing detergents for textiles, kitchen cleansers, house cleansers, cleaning detergents for various hard surfaces and so on, and others.

Furthermore, the present invention relates to a liquid detergent composition which is useful in various fields of washing detergents for textiles, kitchen cleansers, house cleansers, cleaning detergents for various hard surfaces and so on, liquid cleansers, and others.

PRIOR ARTS

In general, surfactants, in particular, nonionic surfactants have low compatibility with aqueous solutions containing an electrolytic salt at a high concentration, such as concentrated alkaline water, and these are not easily made into stable emulsion compositions having a low viscosity.

For example, in the case that a surfactant containing a nonionic surfactant and concentrated alkali water are used in combination and the combination is used as an alkaline detergent liquid, JP-A5-209198 and JP-B 7-37635 disclose surfactants constructed into a lamella or the like with a salt or the like. However, these make use of the constructive property of the surfactants; therefore, these are affected by temperature, the combination of the surfactants to be incorporated, and others. Thus, it is difficult to design the surfactants freely. Moreover, the surfactants may have a high viscosity by the constructing, so as to have problems such that workability lowers. JP-A 10-168493 discloses the use of a dissolution aid, such as nonenyl succinate, for dissolving a nonionic surfactant. However, this technique has a problem such that the amount of the nonionic surfactant which can be blended is small.

Furthermore, EP-A953631 discloses a composition containing surfactants containing a nonionic surfactant and concentrated alkaline water at high concentrations, using an alkylpolyglycoside as an emulsion stabilizer. However, the composition has a high viscosity so as to have problems about the flexibility of design and workability.

JP-A 11-181587 discloses that the liquid detergent including an alkali agent, an ethylenically unsaturated organic acid monomer and water.

SUMMARY OF THE INVENTION

The present invention provides an emulsion composition containing an optically isotropic surfactant phase containing a nonionic surfactant (hereinafter the phase being referred to as the surfactant phase), and an aqueous solution phase containing an electrolytic salt (hereinafter the phase being referred to as the aqueous solution phase), the amount of the salt being such an amount that the aqueous solution phase is incompatible with the surfactant phase, wherein the surfactant phase and the aqueous solution phase are stabilized with a polymer including a segment (a) having affinity with the aqueous solution phase and a segment (b) having affinity with the surfactant phase (hereinafter the polymer being referred to the emulsifier polymer).

The present invention also provides a liquid detergent composition containing the above-mentioned emulsion composition, and inorganic builder particles dispersed in the emulsion composition.

The present invention also provides a process for producing the above-mentioned liquid detergent composition including the step of mixing an emulsion composition containing the emulsifier polymer, the electrolytic salt, the nonionic surfactant and water with inorganic builder particles.

Further the present invention relates to use of the above-mentioned emulsion composition for a liquid detergent.

DETAILED DESCRIPTION OF THE INVENTION

Figure 1:
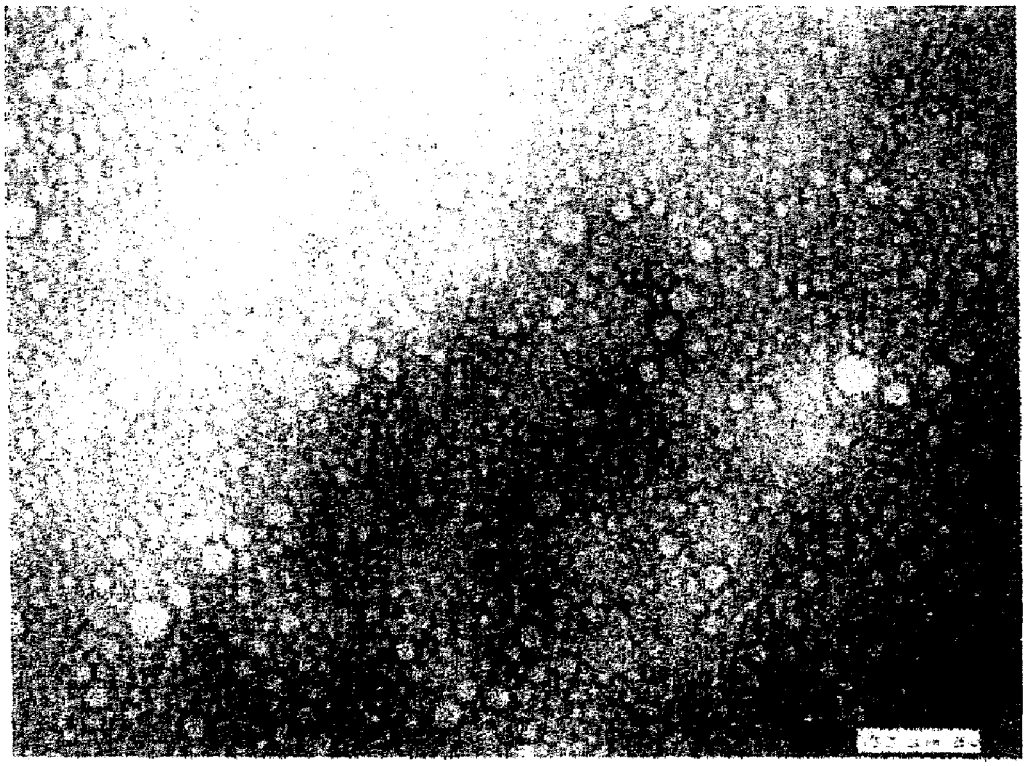
FIG. 1 is a microscopic photograph of the product of Example 5.

JP-A 11-181587 is different from the present invention using the specific polymer.

The present inventors presented EP-A 1 162 255 disclosing a liquid detergent composition including a liquid phase, a polymer dispersant and a crystalline silicate compound and JP-A 2003-27088 disclosing a liquid detergent composition containing a liquid dispersion medium and a solid dispersant, the solid dispersant being stabilized with a specific polymer. Those are not any emulsion type and the effect of the present invention is not achieved there.

The present invention relates to an emulsion composition, containing water, a nonionic surfactant and an electrolytic salt, separated into two or more phases containing a surfactant phase including a nonionic surfactant and an aqueous solution phase including an electrolytic salt, respectively, the phases being incompatible with each other, is emulsified and stabilized with a polymer.

Furthermore, the present invention relates to a liquid detergent composition which is excellent in detergent power; has a low viscosity to be easily handled; is good at stability; and is inexpensive; and exhibits no increased viscosity even if the composition is mixed with a small amount of water.

Thus, the inventors have made an intensive study to solve those problems and emulsify a composition which contains a nonionic surfactant, water and an electrolytic salt and which is separated into two or more phases of a surfactant phase including a nonionic surfactant and an aqueous solution phase including an electrolytic salt, the phases being incompatible with each other, with stability and a low viscosity. They have found that use of a specific polymer makes it possible to produce an emulsion composition wherein droplets are stabilized and have attained the present invention.

[Emulsion Composition]

The emulsion composition of the present invention is an emulsion composition wherein the aqueous solution phase and the surfactant phase are stabilized with the emulsifier polymer. Accordingly, it appears that at least one portion of the emulsifier polymer is present in the interface between the surfactant phase and the aqueous solution phase.

In the emulsion composition of the present invention, the amount of the electrolytic salt is not less than such an amount that the aqueous solution phase and the surfactant phase are separated from each other in the absence of the emulsifier polymer. That is, the adjustment of the presence amount of the electrolytic salt makes it possible that the surfactant phase and the aqueous solution phase turn into the state that they are incompatible with each other in the absence of the emulsifier polymer. Furthermore, the presence amount of a water-soluble organic solvent which contains a hydroxyl group, which will be described later, as well as the presence amount of the electrolytic salt, also makes the arrangement possible.

The emulsion state in the present invention may be the state that the surfactant phase is present as droplets in the aqueous solution phase, or the state that the aqueous solution phase is present as droplets in the surfactant phase. The former is preferable. It is also preferable that the mass of the aqueous solution phase is larger than that of the surfactant phase.

The emulsion composition used in the liquid detergent composition of the present invention is a composition wherein the optically isotropic surfactant phase, which contains the nonionic surfactant, is present as droplets in the aqueous solution phase, which contains the electrolytic salt, and is a composition stabilized with the emulsifier polymer having the segment (a) having affinity with the aqueous solution phase and the segment (b) having affinity with the surfactant phase.

Herein, the optical isotropy typically means that when a product is watched through a microscope between polarized light rays, the product is uniformly black and exhibits continuity, which essentially has no characteristics, and means that in X-ray or neutron diffraction plots, the presence of liquid crystal in a hexagonal, lamella, spherular or some other form is not suggested. It is sufficient that the surfactant phase is optically isotropic. However, the whole of the composition may be optically isotropic. When the composition is optically isotropic, no construction is formed therein. Thus, the composition has a low viscosity so as to be easily handled.

The particle size of the droplets is not particularly limited. For example, according to measurement with an optical microscope, the size is preferably from 0.1 to 10 μm, more preferably from 0.1 to 3.0 μm.

The emulsion composition of the present invention is a liquid in which its viscosity at 25° C. measured by the method in Examples, which will be described later, is preferably 3000 mPa·s or less, more preferably 2000 mPa·s or less, and even more preferably 1000 mPa·s or less in order to improve workability. In order to make the stability of emulsion composition high, the viscosity is preferably 10 mPa·s or more, more preferably 30 mPa·s or more.

The pH (at 25° C.) of the emulsion composition of the present invention is preferably from 5 to 14, more preferably from 6 to 13 according to the measuring method in Examples, which will be described later.

The emulsion composition of the present invention has stable dispersibility. The stable dispersibility, it is preferable that the degree of separation by volume of the emulsion composition of the present invention is 5% or less after the composition is stored at room temperature (25° C.) for one week, preferably from one month from the production of the composition. The degree of separation by volume means the percentage of the volume of a transparent or semitransparent liquid phase portion generated in the upper phase and/or the lower phase by separation of the emulsion in the whole of the composition. Specifically, the degree is measured by the method in Examples, which will be described later.

The emulsion composition of the present invention is preferably for detergents, and is more preferably for washing fabric or for washing hard surfaces.

The emulsion composition in the liquid detergent composition of the present invention is preferably 50% or more by mass, more preferably 60% or more by mass, and is preferably 95% or less by mass, more preferably 90% or less by mass.

[Surfactant Phase]

The surfactant phase in the emulsion composition is preferably from 5 to 80% by mass, more preferably from 10 to 60% by mass, and particularly preferably from 20 to 60% by mass.

The surfactant phase contains a nonionic surfactant, and may contain a water-soluble organic solvent, other anionic, cationic and amphoteric surfactants, a perfume, which will be described later, and water or some other additive.

When the total amount of the surfactant phase is regarded as 100 parts by mass, the content of the surfactant in the surfactant phase is preferably from 50 to 100 parts by mass, more preferably from 60 to 100 parts by mass, and even more preferably from 70 to 100 parts by mass from the viewpoint of the stability of the emulsion state.

When the total amount of the surfactant phase is regarded as 100 parts by mass, the content of the nonionic surfactant in the surfactant phase is preferably from 50 to 100 parts by mass, more preferably from 70 to 100 parts by mass, and even more preferably from 80 to 100 parts by mass from the viewpoint of the stability of the emulsion state.

When the total amount of the surfactant(s) in the emulsion composition and/or in the liquid detergent composition is regarded as 100 parts by mass, the content of the nonionic surfactant is preferably from 40 to 100 parts by mass, more preferably from 50 to 100 parts by mass, even more preferably from 60 to 100 parts by mass and even more preferably from 80 to 100 parts by mass from the viewpoint of the stability of the emulsion state.

(Nonionic Surfactant)

Hitherto, the use of a nonionic surfactant incorporated in a detergent composition has been performed, and the use is preferable because of excellent detergency and stability. The amount of the nonionic surfactant in the whole of the emulsion composition and/or in the liquid detergent composition is preferably 10% or more by mass, more preferably 15% or more by mass, and is preferably 60% or less by mass, more preferably 50% or less by mass, and even preferably 40% or less by mass.

The total amount of the surfactant(s) in the total of the emulsion composition and/or in the liquid detergent composition is preferably 10% or more by mass, more preferably 15% or more by mass, and even more preferably 21% or more by mass from the viewpoint of detergency, and preferably 65% or less by mass, more preferably 55% or less by mass, and even more preferably 45% or less by mass from the viewpoint of emulsification stability.

In the nonionic surfactant used in the present invention, the HLB according to Davies [equation (5·1·11) on page 235 in New Edition Surfactant Handbook (edited by Kogakutosho Ltd.) published on Jan. 20, 1991] is preferably 16 or less in order to maintain the system wherein the surfactant is incompatible with the aqueous solution phase in the absence of any emulsifier polymer, which will be described later, and is preferably 9 or more from the viewpoint of detergency. The HLB is varied dependently on the electric conductivity of the aqueous solution phase, the pH of the emulsion composition, or other factors.

As the nonionic surfactant, known nonionic surfactants described in, for example, "3-1, Collection of Well Known and Customary Techniques (Powder Detergent for Clothing)" published by the Japanese Patent Office can be used.

In the emulsion composition of the present invention, the use of a nonionic surfactant of a polyethylene oxide type and/or polypropylene oxide type is preferable. It is particularly preferable to use one or more selected from polyoxyethylene alkyl ethers wherein ethylene oxide (hereinafter referred to as EO) is added in an amount of 5 to 20 moles on average to a primary or secondary straight or branched alcohol having 8 to 18 carbon atoms; and polyoxyethylene polyoxypropylene alkyl ethers wherein EO is added in an amount of 5 to 15 moles and propylene oxide (hereinafter referred to as PO) is added in an amount of 1 to 5, respectively, on average to the above-mentioned alcohol (provided that EO and PO may be added in a random form or in a black form).

As other nonionic surfactants, the following can be used: polyoxyethylene alkyl phenyl ethers, N-polyoxyethylene-alkylamine, sucrose aliphatic acid esters, aliphatic acid glycerin monoesters, higher aliphatic acid alkanolamides, polyoxyethylene higher aliphatic alkanolamides, amineoxides, alkylglycosides, alkylglyceryl ethers, N-alkylgluconamides or others.

[Aqueous Solution Phase]

The amount of the aqueous solution phase in the emulsion composition is preferably 20% or more by mass, more preferably 30% or more by mass, and even more preferably 40% or more by mass, and is preferably 95% or less by mass, more preferably 90% or less by mass, and even more preferably 80% or less in order to make it into a preferable viscosity.

The water content in the emulsion composition and/or in the liquid detergent composition is preferably 20% or more by mass, more preferably 30% or more by mass, and is preferably 70% or less by mass, more preferably 60% or less by mass, and even more preferably 50% or less by mass.

The electrolytic salt in the aqueous solution phase is present to be dissolved in the aqueous solution phase in an amount not less than such an amount that the surfactant phase and the aqueous solution phase are made incompatible with each other, that is, the composition is separated into upper and lower phases made of two or more phases in the absence of any emulsifier polymer.

In general, therefore, the content of the electrolytic salt in the emulsion composition and/or in the liquid detergent composition of the present invention, which depends on the composition of the emulsion composition, is preferably 4% or more by mass, more preferably 5% or more by mass, even more preferably 6% or more by mass, and is preferably 50% or less by mass, more preferably 32% or less by mass, and even more preferably 20% or less by mass.

About electric conductivity, the electric conductivity of the emulsion composition according to the measuring method which will be described later is preferably 0.5 S/m or more, more preferably 1.0 S/m or more.

The electrolytic salt used in the emulsion composition of the present invention may be an organic salt or an inorganic salt, and is preferably an inorganic salt, and is preferably an alkali metal salt.

In the case that the emulsion composition and/or the liquid detergent composition of the present invention are used as washing detergents for textiles, kitchen cleansers, house cleansers, or the like, it is preferable to use a carbonate of an alkali metal (such as sodium or potassium) in order to suppress the pH thereof when they are used.

In the case that the emulsion composition and/or the liquid detergent composition of the present invention are used as cleansers for cleaning various hard surfaces or the like, liquid cleansers or others, it is also preferable to use a hydroxide of an alkali metal (such as sodium or potassium) or alkaline earth metal, as well as the alkali metal carbonate.

The inorganic salt other than the above is preferably a halide, oxysulfide, oxyphosphide or some other salt of a typical metal or transition metal. Examples thereof include sodium chloride, potassium chloride, magnesium chloride, calcium chloride and mirabilite.

These inorganic salts may be used alone or in the form of a mixture of two or more thereof.

In order to suppress the pH of the emulsion composition, it is allowable to use an alkali metal salt of an organic acid such as citric acid, malic acid, fumaric acid, succinic acid or maleic acid, or an organic salt of an alkaline earth metal salt.

[Emulsifier Polymer]

In order that the surfactant phase or the aqueous solution phase may be stably emulsified to be present as droplets in the aqueous solution phase or the surfactant phase, respectively, the following is used: a polymer having a segment (a) having affinity with the aqueous solution phase and a segment (b) having affinity with the surfactant phase (hereinafter the polymer being referred to the emulsifier polymer). It is preferable from the viewpoint of emulsification stability that the emulsifier polymer does not have any segment having affinity with the both phases of the aqueous solution phase and the surfactant phase.

The amount of the emulsifier polymer in the emulsion composition and in the liquid detergent composition is preferably from 0.01 to 10% by mass, more preferably from 0.1 to 5% by mass, and even more preferably from 0.5 to 5% by mass.

The segment (a) is preferably a polymer chain, and the segment (b) is preferably a polymer chain or an organic group.

In the case of the polymer chain, the wording "having affinity" means that a polymer which has essentially the same structure as the polymer chain and has a weight-average molecular weight of about 2000 to 50000 or a monomer having the polymer chain is dissolved or uniformly dispersed in a subject phase. Specifically, it can be confirmed that the polymer or monomer is dissolved or uniformly dispersed by mixing the polymer or monomer in the subject phase to have a concentration of 5% by mass, stirring the mixture at 60° C. for 30 minutes, returning the temperature of the system to room temperature (25° C.), allowing the system to stand sill for one hour, and subsequently observing that no precipitation or separated phase is generated with the naked eye.

In the case of the organic group, the wording "having affinity" means that any monomer having the organic group is dissolved or uniformly dispersed in a subject phase. Specifically, it can be confirmed that the monomer is dissolved or uniformly dispersed by mixing the monomer in the subject phase to have a concentration of 5% by mass, stirring the mixture at 60° C. for 30 minutes, returning the temperature of the system to room temperature (25° C.), allowing the system to stand sill for one hour, and subsequently observing that no precipitation or separated phase is generated with the naked eye.

As the aqueous solution phase and the surfactant phase, the following can be used: the upper layer (surfactant phase)

and the lower layer (aqueous solution phase) separated when solid components, which are made of the inorganic builder particles and others, and the emulsifier polymer are removed from the composition of the present invention and then the remaining components are mixed.

(Segment (a))

The segment (a) is preferably a polymer chain having in its constituting unit an anionic group or a salt thereof, more preferably a polymer chain having in its constituting unit a carboxyl group or a salt thereof, and may contain a sulfonic acid group, a phosphoric acid group, a phosphonic acid group or a salt thereof.

Such a polymer chain is preferably a (co)polymer of a vinyl monomer having a carboxyl group or a salt thereof (a (co)polymer means a homopolymer or a copolymer). Examples of the monomer include (meth)acrylic acid [(meth)acrylic acid means acrylic acid, methacrylic acid or a mixture thereof] and salts thereof, styrenecarboxylic acid and salts thereof, maleic acid based monomers [maleic anhydride, maleic acid, maleic acid monoester, and maleic acid monoamide, or mixtures made of two or more thereof] and salts thereof, and itaconic acid and salts thereof. One ore more selected from these can be used.

For the moiety having the sulfonic acid group or the salt thereof, a (co)polymer of a vinyl monomer having a sulfonic acid group or a salt thereof is preferable. Examples of the monomer include 2-(meth)acryloyloxyethanesulfonic acid, 2-(meth)acryloyloxypropanesulfonic acid, 2-(meth)acrylamide-2-alkyl (having 1 to 4 carbon atoms)propane sulfonic acid, vinylsulfonic acid, styrenesulfonic acid and other sulfonic acid monomers. One or more selected from these can be used.

For the moiety having the phosphoric acid group, the phosphonic acid or the salt thereof, a (co)polymer of a vinyl monomer having a phosphoric acid group or a salt thereof is preferable.

Examples of the monomer include (meth)acryloyloxyalkyl (having 1 to 4 carbon atoms) phosphoric acid and vinylsulfonic acid and the like.

Examples of the salts of these include metals, ammonium, alkyl or alkenylammonium having 1 to 22 carbon atoms in all, alkyl or alkenyl-substituted pyridinium having 1 to 22 carbon atoms, alkanolammonium having 1 to 22 carbon atoms in all, basic amino acids or the like. A salt of an alkali metal such as sodium or potassium is preferable or the like.

(Segment (b))

The segment (b) may be a segment (b1): a nonionic polymer chain, or a segment (b2): an organic group.

Segment (b1)

Preferable examples of the nonionic polymer chain include chains having a constituting unit deriving from a monomer selected from the following monomer groups (b1-1) to (b1-8), or the following polymers (b1-9) to (b1-11).

(b1-1) Vinyl ethers having a substituted or unsubstituted, saturated or unsaturated alkyl or aralkyl group having 1 to 22 carbon atoms. Preferable examples thereof include methyl vinyl ether, ethyl vinyl ether, 4-hydroxybutyl vinyl ether, phenyl vinyl ether and the like.

(b1-2) Unsubstitued (meth)acrylamides or substituted (meth)acrylamides having, on the nitrogen thereof, a saturated or unsaturated alkyl or aralkyl group having 1 to 22 carbon atoms. Preferable examples thereof include (meth) acrylamide, N-methyl(meth)acrylamide, N,N-dimethyl (meth)acrylamide, N-ethyl(meth)acrylamide, N-t-butyl (meth)acrylamide, (meth)acryloylmorpholine, 2-(N,N-dimethylamino)ethyl(meth)acrylamide, 3-(N,N-dimethylamino)propyl(meth)acrylamide, 2-hydroxyethyl (meth)acrylamide, N-methylol(meth)acrylamide, and N-butoxymethyl(meth)acrylamide.

(b1-3) N-vinylalipahtic amides. Preferable examples thereof include N-vinylpyrrolidone, N-vinylacetoamide, N-vinylformamide and the like.

(b1-4) (Meth)acryl acid esters having a substituted or unsubstituted, saturated or unsaturated alkyl or aralkyl group having 1 to 22 carbon atoms. Preferable examples thereof include methyl (meth)acrylate, ethyl(meth)acrylate, 2-hydroxyethyl ethyl(meth)acrylamide, (meth)acrylate, 2-(N,N-dimethylamino)ethyl(meth)acrylate, 2-methoxyethyl(meth) acrylate, polyethylene glycol mono(meth)acrylate and the like.

(b1-5) Alkylene oxides. Preferable examples thereof include ethylene oxide, propylene oxide and the like.

(b1-6) Cyclic iminoethers. Preferable examples thereof include 2-methyl-2-oxazoline, 2-phenyl-2-oxazoline and the like.

(b1-7) Styrenes. Preferable examples thereof include styrene, 4-ethylstyrene, α-methylstyrene and the like.

(b1-8) Vinyl esters. Preferable examples thereof include vinyl acetate, vinyl caproate and the like.

(b1-9) Polyesters made from a dihydric alcohol and a divalent carboxylic acid. Preferable examples thereof include a polycondensate of polyethylene glycol and terephthalic acid, or a polycondensate of 1,4-butanediol and succinic aid.

(b1-10) Polyamides. A preferable example thereof is a ring-opened polymer of N-methylvalerolactam.

(b1-11) Polyurethanes. Preferable examples thereof include polyaddition products of polyethylene glycol, hexamethylene diisocyanate, and N-methyl-diethanolamine or 1,4-butanediol.

Among these, a polymer chain having an alkyleneoxy group as its constituting unit, which is obtained by polymerizing an alkylene oxide, is particularly preferable.

In the case of the polymer chain having an alkyleneoxy group as its constituting unit, the alkyleneoxy group in the polymer (b) is preferably an ethyleneoxy group and/or a propyleneoxy group. Each of the ethyleneoxy group and the propyleneoxy group may be a homopolymer or a block or random copolymer. The average polymerization degree of the polymer chain (b) is preferably from 40 to 200, and is more preferably from 80 to 150 from the viewpoint of the stability of the emulsion composition and/or the liquid detergent composition. The terminal of the alkyleneoxy group is not limited, and may be have a hydroxyl group. The terminal may have a hydrocarbon group so as to be an ether bond of, for example, a methoxy group, an ethoxy group, a phenoxy group or the like. The hydrocarbon group is preferably an alkyl group having 1 to 30 carbon atoms, more preferably an alkyl group having 1 to 12 carbon atoms. Particularly preferable is 1 to 3 alkyl groups. It can be considered that when the hydrocarbon group is from 9 to 30, the segment (b1) can function as the segment (b2), which will be described later.

Segment (b2): Organic Group

The organic group is preferably a hydrocarbon group having 9 to 30 carbon atoms, more preferably a hydrocarbon group having 12 to 22 carbon atoms. Even more preferable is a straight or branched alkyl group or alkenyl group the carbon atom number of which is as described above. Such a hydrocarbon group is introduced through a monomer having the same hydrocarbon group. Examples of this monomer are as follows. (b2-1) (Meth)acrylic acid esters having a saturated or unsaturated alkyl or aralkyl group having 9 to 30 carbon atoms, preferably 12 to 22 carbon atoms such as nonyl, decyl, tridecyl, lauryl, myristyl, pentadecyl, cetyl, stearyl, iso-stearyl, oleyl, eicosyl or behenyl group. Examples thereof include decyl(meth)acrylate, lauryl (meth)acrylate, myristyl(meth)acrylate, cetyl(meth)acrylate, stearyl(meth)acrylate, behenyl(meth)acrylate, stearyloxy-polyethylene glycol monomethacrylate and the like.

(b2-2) Substituted (meth)acrylamides having one or two saturated or unsaturated alkyl or aralkyl groups which are bonded to the nitrogen and have 9 to 30 carbon atoms, preferably 12 to 22 carbon atoms. Examples thereof include N-lauryl(meth)acrylamide, N-dioctyl(meth)acrylamide and the like. (b2-3) Vinyl ethers having a saturated or unsaturated alkyl or aralkyl group having 9 to 30 carbon atoms, preferably 12 to 22 carbon atoms. Examples thereof include lauryl vinyl ether, myristyl vinyl ether, palmityl vinyl ether, and stearyl vinyl ether and the like.

About the emulsifier polymer in the present invention, it is preferable that the segment (a) is a polymer chain having in its constituting unit a carboxyl group or a salt thereof and the segment (b) is a nonionic polymer chain or a hydrocarbon group having 9 to 30 carbon atoms. It is particularly preferable that the segment (a) is a polymer chain having in its constituting unit a carboxyl group or a salt thereof and the segment (b) is a polymer having a polymer chain including an alkyleneoxy group as its constituting unit.

About the mass ratio of the segment (a) to the segment (b), the ratio of (a)/(b) is preferably from 30/70 to 95/5, more preferably from 35/65 to 90/10, and even more preferably from 40/60 to 90/10. Within this range, the stability of the emulsification is good.

In the case that the segment (a) and the segment (b1) are used out of these, the mass ratio of the segment (a) to the segment (b1), i.e., the ratio of (a)/(b1) is preferably from 30/70 to 90/10, more preferably from 35/65 to 80/20, and even more preferably from 35/65 to 75/25.

In the case that the segment (a) and the segment (b2) are used, the mass ratio of the segment (a) to the segment (b2), i.e., the ratio of (a)/(b2) is preferably from 70/30 to 95/5, more preferably from 70/30 to 93/7.

The emulsifier polymer having the segment (a) and the segment (b) is preferably a block or graft polymer, more preferably a graft polymer.

The method for synthesizing the block or graft polymer is not particularly limited, and may be selected from known methods. The following methods are particularly preferable: the method of using, as a solvent, one or more liquids which constitute the emulsion composition or the liquid detergent composition to polymerize a vinyl type monomer or the like and using a macro-azo initiator having an azo group in a polymer chain (macro-azo initiator method); the method of using a compound having a polymerizable group at one end of a polymer chain (macro-monomer method); the method of radical-polymerizing a monomer newly in the presence of a polymer to link the newly-generated polymer chain to the polymer chain, which coexists in advance, by chain transfer reaction (chain transfer method); and the method of causing a functional group in a polymer chain to react with a terminal of another polymer, so as to produce a graft polymer.

Preferable examples of the emulsifier polymer used in the present invention are described below. The following polymers 1 and 6 are particularly preferable.

1. Copolymer of an ester (preferably, a monoester) made from a polyalkylene glycol and a vinyl monomer having a carboxyl group or a salt thereof, and a vinyl monomer having a carboxyl group or a salt thereof More preferable is a copolymer of a polyalkylene glycol (meth)acrylate and a vinyl monomer having a carboxyl group or a salt thereof, and even more preferable is a copolymer of a polyalkylene glycol (meth)acrylate and (meth)acrylic acid or a salt thereof. Preferable examples thereof include a copolymer of polyethylene glycol mono (meth)acrylate and(meth)acrylic acid or a salt thereof; and a copolymer of poly(ethylene glycol/propylene glycol) mono (meth)acrylate and(meth)acrylic acid or a salt thereof 2. Copolymer of a polyalkylene glycol ether having a reactive unsaturated group (radical-polymerizable unsaturated group) and a vinyl monomer having a carboxyl group or a salt thereof Preferable examples thereof include a copolymer of a polyalkylene glycol ether having a reactive unsaturated group and (meth)acrylic acid or a salt thereof and/or a maleic acid based monomer. The reactive unsaturated group is a radical-polymerizable unsaturated group. Examples of the copolymer include a copolymer of polyethylene glycol allyl ether and (meth)acrylic acid (or a salt thereof) and/or maleic acid (or a salt thereof).

3. Copolymer wherein a monomer having a carboxyl group or a salt thereof is grafted onto a polyalkylene glycol Preferable examples thereof include a graft polymer wherein acrylic acid and malic acid or salts thereof are radical-polymerized in polyethylene glycol, polypropylene glycol or poly(ethylene glycol/propylene glycol).

4. Copolymer of a vinyl monomer having a carboxyl group or a salt thereof using a polyalkylene glycol macro-azo initiator Preferable examples thereof include a block polymer obtained by radical-polymerizing (meth)acrylic acid or a salt thereof.

5. Graft polymer obtained by linking a polymer made from a vinyl monomer having a carboxyl group or a salt and a polyalkylene glycol having a hydroxyl group at its terminal.

Preferable examples thereof include a graft polymer obtained by linking poly(meth)acrylic acid or a salt thereof and polyethylene glycol having a hydroxyl group at its terminal by dehydration reaction.

6. Copolymer of a vinyl monomer having a carboxyl group or a salt thereof and a vinyl monomer having a hydrocarbon group having 9 to 30 carbon atoms Preferable examples thereof include a copolymer of (meth)acrylic acid or a salt thereof and (meth)acrylate having an alkyl group having 9 to 30 carbon atoms.

Besides, a monomer copolymerizable with the monomer described in the above-mentioned 1 to 6 may be copolymerized as far as the advantageous effects of the present invention are not damaged. Examples thereof include the following monomers.

(1a) vinyl monomers having a sulfonic acid group. Preferable examples thereof include styrenesulfonic acid and/or a salt thereof, 2-acrylamide-2-methylpropanesulfonic acid and/or a salt thereof, (meth)allylsulfonic acid and/or a salt thereof and the like.

(2a) Vinyl monomers having a cationic group. Preferable examples thereof include 2-((meth)acryloyloxy)ethyltrimethylammonium chloride, vinylbenzyltrimethylammonium chloride, 2-((meth)acryloyloxy)ethyldimethylethylammonium ethylsulfate, 3-((meth)acrylamide) propyltrimethylammonium chloride, diallyldimethylammonium chloride and the like.

(3a) Vinyl ethers having a substituted or unsubstituted, saturated or unsaturated alkyl or aralkyl group having 1 to 22 carbon atoms. Preferable examples thereof include methyl vinyl ether, ethyl vinyl ether, 4-hydroxybutyl vinyl ether, phenyl vinyl ether and the like.

(4a) Unsubstitued (meth)acrylamides or substituted (meth) acrylamides having on the nitrogen thereof, a saturated or unsaturated alkyl or aralkyl group having 1 to 12 carbon atoms. Preferable examples thereof include (meth)acrylamide, N-methyl(meth)acrylamide, N,N-dimethyl(meth) acrylamide, N-ethyl(meth)acrylamide, N-t-butyl(meth) acrylamide, (meth)acryloylmorpholine, 2-(N,N-dimethylamino)ethyl(meth)acrylamide, 3-(N,N-dimethylamino)propyl(meth)acrylamide, 2-hydroxyethyl (meth)acrylamide, N-methylol(meth)acrylamide, N-butoxymethyl(meth)acrylamide and the like.

(5a) N-vinylalipahtic amides. Preferable examples thereof include N-vinylpyrrolidone, N-vinylacetoamide, N-vinylformamide and the like.

(6a) Styrenes. Preferable examples thereof include styrene, 4-ethylstyrene, α-methylstyreneand the like.

(7a) Vinyl esters. Preferable examples thereof include vinyl acetate, vinyl caproate and the like.

The weight-average molecular weight of the emulsifier polymer used in the present invention, which is according to the measuring method which will be described later, is preferably 1,000,000 or less, more preferably from 1,000 to 500,000, and even more preferably from 5,000 to 300,000.

[Inorganic Builder Particles]

The percentage of inorganic builder particles in the liquid detergent composition of the present invention is preferably 5% or more by mass, more preferably 10% or more by mass in all, and is preferably 50% or less by mass, more preferably 40% or less by mass in all. Within this range, a high detergency and excellent dispersion stability are exhibited. The inorganic builder particles are preferably made of an aluminosilicate compound.

Preferable examples of the aluminosilicate compound include one or more selected from aluminosilicate compounds represented by the general formula (1):

$$(M^1_pM^2_qM^3_rO)_u(M^4_sM^5_tO)_v(Al_2O_3)_w(SiO_2) \quad (1)$$

wherein $M^1$, $M^2$ and $M^3$ each represent Na, K or H; $M^4$ and $M^5$ each represent Ca or Mg; p, q and r each represent a number of 0 to 2 provided that p+q+r=2; s and t each represent a number of 0 to 1 provided that s+t=1; u represents a number of 0 to 1, preferably a number of 0.1 to 0.5; v represents a number of 0 to 1, preferably a number of 0 to 0.1; and w is a number of 0 to 0.6, preferably a number of 0.1 to 0.5.

Examples of such an aluminosilicate compound include types A, X and P of various zeolites, which are generally incorporated in detergents. The type A is particularly preferable. Since zeolite has a high cation exchange ability, zeolite is a highly excellent builder for detergents. In the case that this is incorporated in the detergent composition, the detergency thereof is largely improved. Thus, this case is preferable. An example of such zeolite is a Toyo Builder commercially available from Tosho Corp. It is preferable to use fine particle zeolite produced by the process in JP-A 2001-139322 since the zeolite is easily pulverized into fine particles in the process for producing the detergent composition of the present invention, which will be described later, thereby making the dispersion stability thereof high. In general, commercially available zeolite contains about 20% of water. In the case that this water content is more than the water content that is desired to be contained in the composition, it is preferable that such commercially available zeolite is fired at 450 to 600° C. to remove water, and then used.

The average particle size of the inorganic builder particles is preferably 20 μm or less, more preferably 10 μm or less, and is preferably 0.1 μm or more, more preferably 1 μm or more. Unless other wise specified, the average particle size means the average particle size of the volume-basis particle sizes as determined with a laser diffracting/scattering particle size distribution analyzer, LA-920 (relative refractive index: 1.2, temperature: 20° C. in water) manufactured by Horiba Ltd.

[Water-soluble Organic Solvent which Contains a Hydroxyl] Group

A water-soluble organic solvent which contains a hydroxyl group is used to stabilize the optical isotropy of the surfactant phase and disperse the surfactant phase stably as droplets in the aqueous solution phase. When the emulsifier polymer is produced, the solvent is used as a part of a polymerizing solvent so as to be caused to have a function for adjusting the molecular weight of the emulsifier polymer.

A water-soluble organic solvent which contains a hydroxyl group is not particularly limited. Preferable examples thereof include solvents represented by the general formula(s) (I) and/or (II) and/or (III) and/or (IV).

$$OH[CH_2CH_2O]_a[CH_{2-b}(CH_3)_bCH_{2-c}(CH_3)_cO]_dH \quad (I)$$

$$OH[CH_2CH_2O]_a[CH_{2-b}(CH_3)_bCH_{2-c}(CH_3)_cO]_d—R \quad (II)$$

$$CH_{3-e}(OH)_eCH_{2-f}(OH)_fCH_{3-g}(OH)_g \quad (III)$$

$$CH_{3-h}(OH)_hCH_{2-i}(OH)_iCH_{2-j}(OH)_jCH_{3-k}(OH)_k \quad (IV)$$

wherein is an average added mole number of 1 to 120; d is an average added mole a number of 0 to 30 provided that a>d; b, c, d, e, f, g, h, i, j, and k each represent an integer of 0 or 1 provide that b+c=1, e+f+g=2 or 3 and h+i+j+k=2; and R represents a phenyl group or an aliphatic hydrocarbon group having 1 to 8 carbon atoms.

Specific examples thereof include polyhydric alcohols such as butanediol, pentanediol, hexanediol, glycerin, trimethylolpropane pentaerythritol and the like; mono-, di- or tri-alkyl ethers of polyhydric alcohols; glycols such as ethylene glycol, propylene glycol, polyethylene glycol, polypropylene glycol ethylene oxide/propylene oxide copolymer and the like; monoalklyl ethers and monoaryl ethers of glycols, in particular, monophenyl ethers thereof; and the like. These hydroxyl-group-containing, water-soluble organic solvents are incorporated alone or in a mixture of two or more thereof.

The ratio of the water-soluble organic solvent which contains a hydroxyl group in the emulsion composition of the present invention and/or the liquid detergent composition is preferably from 0 to 45% by mass, more preferably from 2 to 30% by mass, even more preferably from 3 to 20% by mass.

[Other Components]

(1) Anionic Surfactant

Known anionic surfactants described in, for example, "3-1, Collection of Well Known and Customary Techniques (Powder Detergent for Clothing)" published by the Japanese Patent Office can be used in the emulsion composition and the liquid detergent composition of the present invention.

Anionic surfactants of phosphoric acid salt type, carboxylic acid salt type, sulfonic acid type and/or sulfate type are preferably blended.

Specifically, preferable are one or more anionic surfactant agent selected from monoalkyl or alkenylphosphates, aliphatic acid salts, alkyl sulfate salts, polyoxyalkylene alkyl sulfate salts and alkyl benzene sulfonate salts.

Examples of the counter ion for these anionic surfactants include sodium, potassium, magnesium, calcium, cations wherein an amine such as ethanolamine is protonated, quaternary ammonium salts, and mixtures thereof. When the anionic surfactant is blended, it is allowable to use a method of blending the surfactant in an acid form thereof, and adding thereto an alkali (such as ethanolamine) separately.

The ratio of the anionic surfactant in the emulsion composition or the liquid detergent composition of the present invention is an amount not to be optically anisotropic of the surfactant phase, preferably from 0 to 10% by mass, more preferably from 0 to 5% by mass, and even more preferably from 0 to 3% by mass compounded the surfactant phase (2) Cationic Surfactant Known cationic surfactants described in, for example, "3-1, Collection of Well Known and Customary Techniques (Powder Detergent for Clothing)" published by the Japanese Patent Office can be used in the emulsion composition and liquid detergent composition of the present invention. For example, a quaternary ammonium salt such as a benzalconium type salt is preferably blended.

(3) Amphoteric Surfactant

Known amphoteric surfactants described in, for example, "3-1, Collection of Well Known and Customary Techniques (Powder Detergent for Clothing)" published by the Japanese Patent Office can be used in the emulsion composition and the liquid detergent composition of the present invention. For example, an alkylbetaine type amphoteric surfactant is preferably blended.

(4) Organic Builder

The liquid detergent composition of the present invention can contain known organic builders which are dissolved and/or are not dissolved in the emulsion composition and the liquid emulsion composition. Specific examples thereof include polyvalent carboxylic acids such as citric acid, succinic acid, malonic acid and the lie; amino acids such as asparagic acid glutamic acid and the like; aminopolyacetic acids such as nitrilotriacetic acid, ethylenediaminetetraacetic acid, trisodium methylglycinediacetate represented by the following general formula (2), tetrasodium asparagic acid-N,N-diacetate, trisodium serine diacetate, tetrasodium glutamic acid diacetate, trisodium ethylglycine diacetate and the like; and polymeric polyvalent carboxylic acids such as polyacrylic acid, acrylic acid/maleic acid copolymer and the like. These are preferably in the form of a salt such as an alkali metal salt, an ammonium salt, a substituted ammonium salt or the like. The ratio of the organic builder in the emulsion composition and the liquid detergent composition of the present invention is preferably from 0 to 15.0% by mass, more preferably from 1.0 to 10.0% by mass, and even more preferably from 2.0 to 7.0% by mass.

[Compound 1]

(2)

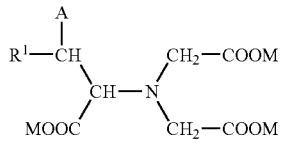

wherein $R^1$ is $—(CH_2)_n—A$ wherein A is H, OH or COOM wherein M is H, Na, K or $NH_4$, and n is a number of 0 to 5.

(5) Other Organic Solvents

As organic solvents other than the water-soluble organic solvent which contains a hydroxyl group, the following are blended: an alkylamine, an aliphatic amine, an amide or alkyl ester of analiphatic or aromatic carboxylic acid, a lower alkyl ester, a ketone, an aldehyde, a glyceride, and others. The ratio of the other solvents in the emulsion composition and/or the liquid detergent composition of the present invention is preferably from 0 to 50% by mass, more preferably from 0 to 20% by mass, and even more preferably from 0 to 10% by mass from the viewpoints of the detergency and the compactness of the detergent composition.

(6) Bleaching Agent

It is also preferable that the emulsion composition and the liquid detergent composition of the present invention contains a bleaching agent. The bleaching agent may be an inorganic peroxy bleaching agent, or a combination of an inorganic peroxy bleaching agent and a bleach-activating agent.

Examples of the inorganic peroxy bleaching agent include perborates, percarbonates, persilicates and perphosphates of alkali metals. Sodium perborate and sodium percarbonate are particularly preferable. In order to improve the dispersion stability of the product to be obtianed, there can be used a percarbonate salt coated with a carboxylic acid type polymer and/or a polyvalent carboxylic acid, as described in lines 13-44, column 2, on page 2 in JP-A 11-279593.

In the case that a combination of an inorganic peroxy bleaching agent and a bleach-activating agent is used, the bleach-activating agent is usually an organic compound having a reactive acyl group which can make a peracid. The bleaching effect thereof is more effective than in the case that the inorganic peroxy bleaching agent only is used. The structure of the bleach-activating agent is not particularly limited. An activator represented by the following general formula (3) is preferable.

(3)

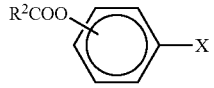

wherein $R^2$ represents a straight or branched chain alkyl group having 1 to 15 carbon atoms, and X represents COOM or $SO_3M$ wherein M represents a hydrogen atom, an alkali metal atom or an alkaline earth metal atom.

The bleach-activating agent represented by the general formula (3) is preferably an activator wherein $R^2$is a straight or branched chain alkyl group having 7 to 11 carbon atoms and X is COOH or $SO_3Na$ in the general formula (3).

Examples of such a bleach-activating agent include sodium lauroyloxybenzenesulfonate, sodium decanoyloxybenzenesulfonate, sodium octanoyloxybenzenesulfonate, lauroyloxybenzoic acid, decanoyloxybenzoic acid, octanoyloxybenzoic acid and the like.

(Oil)

A known oil may be incorporated in the emulsion composition and the liquid detergent composition of the present invention. Specific examples thereof include oil components as follows: hydrocarbons such as liquid paraffin, squalane, vaseline, solid paraffin and the like; natural oils such as olive oil, jojoba oil, primrose oil, coconut oil, beef tallow and the like; ester oils such as isopropyl myristate, cetyl isooctanoate, neopentyl glycol dicaprate and the like; silicone oils such as dimethyl silicone, methylphenyl silicone and the like; higher fatty acids such as isostearic acid, oleic acid and the like.

Besides, known builders for detergents, such as silicates or metasilicates, which are used in ordinary detergents, can be incorporated at will. These are preferably alkali metal salts thereof. For example, the following can be used: a phosphate such as tripolyphosphate, pyrophosphate or the like, aminotri(methylenephosphonic acid), 1-hydroxyethylidene-1,1-diphosphonic acid, ethylenediaminetetra(metylenephosphonic acid), diethylenetriaminepenta(methylenephosphonic acid) or a salt thereof. Moreover, if necessary, the following may be contained: a polymer such as polyethylene glycol, carboxymethylcellulose or the like; a color transfer inhibitor such as polyvinyl pyrrolidone; an enzyme such as protease, cellulase, lipase or the like; an enzyme stabilizer such as calcium chloride, formic acid, boric acid or the like; a phase-adjusting agent such as p-toluenesulfonic acid, m-xylenesulfonic acid, benzoic acid or the like; an antifoamer such as silicone; an antioxidant such as butylhydroxytoluene, di-styrenized cresol, sodium sulfite, and sodium hydrogensulfite; a perfume component; a dye; a fluorescent dye; a pigment; or the like.

[Liquid Detergent Composition]

The liquid detergent composition of the present invention contains an emulsion composition wherein a surfactant phase is stably emulsified and dispersed as droplets in an aqueous solution phase, and inorganic builder particles dispersed in the emulsion composition, and is stabilized with an emulsifier polymer.

In the detergent composition of the present invention, the inorganic builder particles are stably dispersed. It is presumed that the particles are dispersed and stabilized by interaction between the inorganic builder particles and the surfactant phase stabilized as the droplets. Furthermore, it is considered that the emulsifier polymer also contributes directly or indirectly to the stabilization of the inorganic builder particles.

In the liquid detergent composition of the present invention, the mass ratio between the inorganic builder particles and the emulsifier polymer, i.e., the ratio of the emulsifier polymer/the inorganic builder particles is preferably from 1/80 to 1/4, more preferably from 1/60 to 1/5, and even more preferably from 1/40 to 1/8.

About the liquid detergent composition of the present invention, the viscosity at 25° C. measured by the method in Examples, which will be described later, is preferably 3000 mpa·s or less, more preferably 2000 mPa·s or less in order to improve workability. The viscosity is preferably 10 mPa·s or more, more preferably 50 mPa·s or more in order to prevent scattering of the liquid detergent composition and make the stability of the inorganic builder particles high.

The liquid detergent composition of the present invention is preferably alkaline in order to make the detergency thereof high. The pH (at 20° C.) thereof, which is according to the method in Examples described later, is preferably from 7 to 14, more preferably from 9 to 13.

The liquid detergent composition of the present invention has stable dispersibility. For the stable dispersibility, it is preferable that the degree of separation by volume of the liquid detergent composition of the present invention is 5% or less after the composition is stored at room temperature (25° C.) for one week, preferably one month from the production of the composition. The degree of separation by volume means the ratio of the volume of a transparent liquid phase or a semitransparent portion in the whole volume of the composition, the phase or portion being generated in the upper portion by precipitation and separation of solid dispersoids. Specifically, the degree is measured by the method in Examples, which will be described later.

[Production Process]

For the production of the emulsion composition of the present invention, a method of mixing and stirring all components may be used. In order to yield a homogeneous and stable emulsion composition, it is preferable to use the following method. That is, preferable is a method of mixing a mixture of an emulsifier polymer, an aqueous solution containing an electrolytic salt, and an water-soluble organic solvent which contains hydroxyl group with a mixture of a surfactants, containing a nonionic surfactant, and other components under stirring, thereby preparing an emulsion.

The mixing under stirring is preferably conducted at a temperature of 15 to 30° C.

For the production of the liquid detergent composition of the present invention, a method of mixing and stirring all components may be used. In order to yield a homogeneous stable liquid detergent composition, it is preferable to use a method of mixing inorganic builder particles with an emulsion wherein an emulsifier polymer, an electrolytic salt, a nonionic surfactant, and water are mixed and preferably a water-soluble organic solvent, a different surfactant and others are also mixed therewith. More preferable is a method of adding a nonionic surfactant to a mixed solution wherein an emulsifier polymer, an electrolytic salt, and water are mixed and preferably a water-soluble organic solvent is also mixed therewith; mixing the components under stirring to prepare an emulsion; and then mixing inorganic builder particles with the emulsion.

When the inorganic builder particles, it is allowable to wet-pulverize the particles beforehand in an aqueous slurry, and then mix the resultant. The aqueous slurry is a substance wherein the inorganic builder particles are contained in a liquid emulsion composition made mainly of water.

As the method for the mixing under stirring, a known method is used. It is preferable to use a homomixer, a disperser, a homogenizer or the like which gives a high stirring power. The following may be used: a pulverizer having a liquid jet interaction chamber (such as a microflydizer manufactured by Microflydex Co., Ltd.), an ultrasonic dispersion instrument, or the like.

As the wet-pulverizing method in the aqueous slurry, the following can be listed up: a stone mill, a colloid mill, a KD mill, a slasher mill, a high-speed disperser, a media mill, a roll mill, a kneader, an extruder, a pulverizer having a liquid jet interaction chamber (such as a micro-flydizer manufactured by Microflydex Co., Ltd.), an ultrasonic dispersion instrument and the like. In particular, wet-pulverizing using media, for example, a method using a sand mill, a sand grinder, a wet vibration mill, an attritor or the like is preferable from the viewpoint of the efficiency of pulverization. As the media, known materials such as titania or zirconia can be used.

The emulsion composition of the present invention is a composition emulsified stably with the emulsifier polymer having polymer chains exhibiting affinity with the aqueous solution phase, which contains the electrolytic salt, and the surfactant phase, which contains the nonionic surfactant. A relatively large amount of the surfactant can stably be incorporated therein.

Furthermore, the liquid detergent composition of the present invention is a composition wherein an inorganic builder is dispersed and stabilized in the above-mentioned emulsion composition. The composition is easily poured into a washing tank and speedily dissolved into washing water. The liquid detergent composition of the present invention makes it possible that particles of the inorganic builder which have a relatively large particle size of several micrometers are stably dispersed therein and further a relatively large amount of water is incorporated therein. Therefore, the composition can be produced at low costs. The viscosity of the composition does not increase even in the step in which the composition is diluted at the time of washing.

EXAMPLES

Following example 1 to 6 and 11 to 19 shows embodiment of the present invention. The following examples further describe and demonstrate embodiments of the present invention. The examples are given solely for the purpose of illustration and are not to be construed as limitations of the present invention.

The symbol "%" is an abbreviation of "% by mass" unless otherwise specified.

Molecular weight was measured by gel permeation liquid chromatography (GPC). About polymers of Synthesis Examples 1 to 3, 7 and 9, the following conditions were used. Each of an eluent and added salts was prepared from a reagent in a grade for liquid chromatography.

Column: two columns of a G4000PWXL and a G2500PWXL, manufactured by Tosoh Corp.

Eluent: 0.2 M phosphoric acid buffer solution (pH: 6.9)/acetonitrile=9/1 (volume ratio)

Detector: Differential refractometer

Temperature: 40° C.

Standards: polyethylene glycol, and polyethylene oxide

Measurement concentration: 5 mg/mL

Injected amount: 100 μL

About polymers of Synthesis Examples 4 to 6, and 8, the following conditions were used.

Column: two columns of an α-M and an α-M, manufactured by Tosoh Corp.

Eluent: 60 mmol/L phosphoric acid, and 50 mmol/L LiBr/DMF

Detector: Differential Refractometer

Temperature: 40° C.

Standards: polyethylene glycol, and polyethylene oxide

Measurement concentration: 5 mg/mL

Injected amount: 100 μL

Synthesis Example 1

Synthesis Example of a Synthesis Polymer Solution (1) [Polyethylene Glycol (Mole Number of EO Added: 90) Monomethacrylate/methacrylic Acid (Mass Ratio: 50/50) Copolymer]

In nitrogen atmosphere, the temperature of 122 g of ion exchange water and 122 g of propylene glycol was raised to 80° C. Thereto were dropwise added a solution wherein 150 g of polyethylene glycol (mole number of EO added: 90) monomethacrylate (NK-ester M-900G, manufactured by Shin-Nakamura Chemical Co., Ltd.), 150 g of methacrylic acid and 4.2 g of 2-mercaptoethanol were dissolved in a mixed liquid of 50 g of ion exchange water and 100 g of propylene glycol, and a solution wherein 4.2 g of sodium persulfate and 1.7 g of 35% hydrogen peroxide water were dissolved in 50 g of ion exchange water, separately, over 2 hours while the temperature of the system was kept at 80 to 85° C. Thereafter, the resultant solution was stirred for 4 hours while the temperature of the system was kept at 80° C. This was cooled to yield a synthesis polymer solution (1). The resultant synthesis polymer was measured by GPC. As a result, the weight-average molecular weight thereof was 46,000 (determined using polyethylene glycol standards).

Synthesis Example 2

Synthesis Example of a Synthesis Polymer Solution (2) [Polyethylene Glycol (Mole Number of EO Added: 90) Monomethacrylate/methacrylic Acid/sodium Styrenesulfonate (Mass Ratio: 50/30/20) Copolymer]

In nitrogen atmosphere, the temperature of 14.1 g of propylene glycol was raised to 80° C. Thereto were dropwise added a solution wherein 50 g of polyethylene glycol (mole number of EO added: 90) monomethacrylate (NK-ester M-900G, manufactured by Shin-Nakamura Chemical Co., Ltd.), 30 g of methacrylic acid, 0.5 g of 2-mercaptoethanol and 20 g of sodium styrenesulfonate were dissolved in a mixed liquid of 48.9 g of ion exchange water and 60 g of propylene glycol, and a solution wherein 1.1 g of sodium persulfate and 0.44 g of 35% hydrogen peroxide water were dissolved in 25 g of ion exchange water, separately, over 2 hours while the temperature of the system was kept at 80 to 85° C. Thereafter, the resultant solution was stirred for 4 hours while the temperature of the system was kept at 80° C. This was cooled to yield a synthesis polymer solution (2). The resultant synthesis polymer was measured by GPC. As a result, the weight-average molecular weight thereof was 87,000 (determined using polyethylene glycol standards).

Synthesis Example 3

Synthesis Example of a Synthesis Polymer Solution (3) [Polyethylene Glycol (Mole Number of EO Added: 90) Monomethacrylate/methacrylic Acid (Mass Ratio: 43/57) Copolymer]

In nitrogen atmosphere, the temperature of 16.6 g of ion exchange water and 16.6 g of propylene glycol was raised to 80° C. Thereto were dropwise added a solution wherein 67.9 g of polyethylene glycol (mole number of EO added: 90) monomethacrylate (NK-ester M-900G, manufactured by Shin-Nakamura Chemical Co., Ltd.), 90 g of methacrylic acid and 2.5 g of 2-mercaptoethanol were dissolved in a mixed liquid of 50 g of ion exchange water and 100 g of propylene glycol, and a solution wherein 2.5 g of sodium persulfate and 1.0 g of 35% hydrogen peroxide water were dissolved in 50 g of ion exchange water, separately, over 2 hours while the temperature of the system was kept at 80 to 85° C. Thereafter, the resultant solution was stirred for 4 hours while the temperature of the system was kept at 80° C. This was cooled to yield a synthesis polymer solution (3). The resultant synthesis polymer was measured by GPC. As a result, the weight-average molecular weight thereof was 41,000 (determined using polyethylene glycol standards).

Synthesis Example 4

Synthesis Example of a Synthesis Polymer Dispersion (4) [Lauryl Methacrylate/acrylic Acid (Mass Ratio: 12.5/87.5) Copolymer]

In nitrogen atmosphere, the temperature of 7.1 g of ion exchange water and 2.4 g of isopropyl alcohol was raised to 80° C. Thereto were dropwise added a solution wherein 15.4 g of lauryl methacrylate (Exceparl L-MA, manufactured by Kao Corp.) and 135 g of acrylic acidwere dissolved inamixed liquid of 173 g of ion exchange water and 200 g of isopropyl alcohol, and a solution wherein 2.0 g of sodium persulfate was dissolved in 49 g of ion exchange water, separately, over 3 hours while the temperature of the system was kept at 80 to 85° C. Thereafter, the resultant solution was stirred for 4 hours while the temperature of the system was kept at 80° C. Next, the mixed liquid of isopropyl alcohol and the ion exchange water was distilled off with an evaporator to yield a synthesis polymer (4) having a solid content concentration of 45.0%. The resultant synthesis polymer was measured by GPC. As a result, the weight-average molecular weight thereof was 10,000 (determined using polyethylene glycol standards).

Synthesis Example 5

Synthesis Example of a Synthesis Polymer Dispersion (5) [2-ethylhexyloxy Polypropylene Glycol (Mole Number of PO Added: 6) Polyethylene Glycol (Mole Number of EO Added: 8) Monomethacrylate/methacrylic Acid (Mass Ratio: 30/70) Copolymer]

In nitrogen atmosphere, the temperature of 31.2 g of ion exchange water and 31.2 g of isopropyl alcohol was raised to 80° C. Thereto were dropwise added a solution wherein 42.9 g of 2-ethylhexyloxy polypropylene glycol (mole number of PO added: 6) polyethylene glycol (mole number of EO added: 8) monomethacrylate (Blemmer 50POEP800B, manufactured by NFO Corp.), 100 g of acrylic acid and 2.83 g of 2-mercaptoethanol were dissolved in 51.8 g of propylene glycol, and a solution wherein 5.76 g of sodium persulfate was dissolved in 51.8 g of ion exchange water, separately, over 2 hours while the temperature of the system was kept at 80 to 85° C. Thereafter, the resultant solution was stirred for 1 hour while the temperature of the system was kept at 80° C. This was cooled to yield a synthesis polymer (5). The resultant synthesis polymer was measured by GPC. As a result, the weight-average molecular weight thereof was 14,000 (determined using polyethylene glycol standards).

Synthesis Example 6

Synthesis Example of a Synthesis Polymer Dispersion (6) [Stearyloxy Polyethylene Glycol (Mole Number of EO Added: 30) Monomethacrylate/methacrylic Acid (Mass Ratio: 45/55) Copolymer]

In nitrogen atmosphere, the temperature of 18.5 g of ion exchange water and 19.0 g of isopropyl alcohol was raised to 80° C. Thereto were dropwise added a solution wherein 40.9 g of stearyloxy polyethylene glycol (mole number of EPO added: 30) monomethacrylate (Blemmer PSE1300, manufactured by NFO Corp.), 50 g of methacrylic acid and 0.95 g of 2-mercaptoethanol were dissolved in 70 g of propylene glycol, and a solution wherein 2.89 g of sodium persulfate was dissolved in 26 g of ion exchange water, separately, over 2 hours while the temperature of the system was kept at 80 to 85° C. Thereafter, the resultant solution was stirred for 1 hour while the temperature of the system was kept at 80° C. This was cooled to yield a synthesis polymer (6). The resultant synthesis polymer was measured by GPC. As a result, the weight-average molecular weight thereof was 15,000 (determined using polyethylene glycol standards).

Synthesis Example 7

Synthesis of an Aqueous Polymethacrylic Acid Solution

In nitrogen atmosphere, the temperature of a mixture of 810 g of 2-propanol and 540 g of ion exchange water was raised to 83° C. while the mixture was stirred. Thereto were dropwise added a solution wherein 443.7 g of methacrylic acid was dissolved in 810 g of ion exchange water, and a solution wherein 98.2 g of sodium persulfate was dissolved in 530 g of ion exchange water, simultaneously, over 2 hours. During the addition, the internal temperature of the stirred solution was kept at 81 to 83° C. After the addition, the solution was stirred at 81 to 83° C. for 5 hours. Thereafter, the solution was further heated under the atmospheric pressure to distill off 2-propanol. The distilling-off was conducted until the rise in the temperature of the vapor stopped (near 101° C.). The temperature of the system was returned to room temperature to yield 1640 g of an aqueous solution containing 33% of polymethacrylic acid. The resultant synthesis polymer was measured by GPC. As a result, the weight-average molecular weight thereof was 42,000 (determined using polyethylene glycol standards).

Synthesis Example 8

Synthesis Example of Polyethylene Glycol (Mole Number of EO Added: 94) Allyl Ether Addition polymerization reaction of EO and PO was conducted in an autoclave made of stainless steel. Potassium hydroxide used as a catalyst was made of plate-form pellets in a grade for industry, and the purity thereof was about 96% by mass (the balance being made mainly of water).

Into the autoclave were charged 350 parts by mass of ethylene glycol monoallyl ether (manufactured by Nippon Nyukazai Co., Ltd.) and3.9 parts bymass of potassiumhydroxide, and then the air in the system was substituted with nitrogen. Thereafter, the system was air-tightly sealed. The solution was heated while being stirred. The internal temperature and the inner pressure thereof were kept at 130° C. and 0.08 MPa, respectively. The introduction of EO was then started. EO was slowly introduced in such a manner that the internal temperature would be not more than 150° C. and the internal pressure would be not more than 0.4 MPa. After a stop in the rise in the internal temperature by generated heat was observed, the introduction of EO was continued while the internal temperature and the internal pressure were kept at 150° C. and 0.4 MPa, respectively. Finally, 5736 parts by mass of EO were introduced over 4.5 hours. Subsequently, the solution was stirred for about 30 minutes while the internal temperature was kept at 150° C. Thereafter, the internal temperature was lowered to 80° C. totakeout the product. The product was cooled to room temperature so as to yield a white wax-form solid. The solid was measured by GPC. As a result, the weight-average molecular weight thereof was 2530.

Synthesis Example 9

Synthesis Example of a Synthesis Polymer Solution (7) [Polyethylene Glycol (Mole Number of EO Added: 94) Allyl Ether/acrylic Acid (Mass Ratio: 60/40) Copolymer]

In nitrogen atmosphere, the temperature of 72 g of polyethylene glycol (mole number of EO added: 94 allyl ether) obtained in Synthesis Example 8, 30 g of ion exchange water and 70 g of propylene glycol was raised to 80° C. Thereto were dropwise added a solution wherein 48 g of acrylic acid was dissolved in 37 g of ion exchange water and a solution wherein 4.88 g of sodium persulfate and 3.99 g of 35% hydrogen peroxide water were dissolved in 30 g of ion exchange water, separately, over 30 minutes while the temperature of the system was kept at 80 to 85° C. Thereafter, the resultant solution was stirred for 3 hours while the temperature of the system was kept at 80° C. This was cooled to yield a synthesis polymer solution (7). The resultant synthesis polymer was measured by GPC. As a result, the weight-average molecular weight thereof was 61,000 (determined using polyethylene glycol standards).

(1) Preparation of an Emulsion Composition

Example 1

First step: Into a 300 mL beaker were put 2.3 g of the synthesis polymer solution (1), 38 g of diethylene glycol mono n-butyl ether, 8.8 g of propylene glycol and 9.9 g of ion exchange water, and then the solution was stirred to prepare a homogeneous solution. Into the solution was incorporated a solution prepared by dissolving 14 g of sodium carbonate into 94 g of ion exchange water. Thereto were added 35.5 g of a nonionic surfactant (1), 11.8 g of a nonionic surfactant (2) and 1.8 g of an anionic surfactant, and then the components were mixed.

Second step: The mixed liquid prepared in the first step was transferred into a 250 mL container made of polypropylene and having a lid, and then the lid was put on the container. Thereafter, the container was vigorously shaken up and down for one minute, thereby preparing an emulsion. The resultant emulsion was uniform.

Example 2

First step: Into a 300 mL beaker were put 2.3 g of the synthesis polymer solution (1), 38 g of diethylene glycol mono n-butyl ether, 8.8 g of propylene glycol and 9.9 g of ion exchange water, and then the solution was stirred to prepare a homogeneous solution. Into the solution was incorporated a solution prepared by dissolving 14 g of sodium carbonate into 94 g of ion exchange water. Thereto were added 35.5 g of the nonionic surfactant (1), 11.8 g of the nonionic surfactant (2) and 1.8 g of the anionic surfactant, and then the components were mixed.

Second step: The mixed liquid prepared in the first step was emulsified by means of a homomixer (TK Robo Mix f Model, TK Homomixer MARK II 2.5 Stirring Parts, hereafter the same as here) manufactured by Tokusyu Kika Kogyo Co., Ltd. The emulsification was performed under a condition of 9000 rpm for 5 minutes. The resultant emulsion was uniform.

Example 3

First step : Into a 300 mL beaker were put 2.3 g of the synthesis polymer solution (3), 38 g of diethylene glycol mono n-butyl ether, 8.8 g of propylene glycol and 9.9 g of ion exchange water, and then the solution was stirred to prepare a homogeneous solution. Into the solution was incorporated a solution prepared by dissolving 14 g of sodium carbonate into 94 g of ion exchange water. Thereto were added 35.5 g of the nonionic surfactant (1), 11.8 g of the nonionic surfactant (2) and 1.8 g of the anionic surfactant, and then the components were mixed.

Second step: The mixed liquid prepared in the first step was emulsified by means of a homomixer manufactured by Tokusyu Kika Kogyo Co., Ltd. The emulsification was performed under a condition of 9000 rpm for 5 minutes. The resultant emulsion was uniform.

Comparative Example 1

First step: Into a 300 mL beaker were put 38 g of diethylene glycol mono n-butyl ether, 9.6 g of propylene glycol and 10.6 g of ion exchange water, and then the solution was stirred to prepare a homogeneous solution. Into the solution was incorporated a solution prepared by dissolving 14 g of sodium carbonate into 94 g of ion exchange water. Thereto were added 35.9 g of the nonionic surfactant (1), 11.9 g of the nonionic surfactant (2) and 1.8 g of the anionic surfactant, and then the components were mixed.

Second step: The mixed liquid prepared in the first step was transferred into a 250 mL container made of polypropylene and having a lid, and then the lid was put on the container. Thereafter, the container was vigorously shaken up and down for one minute, thereby preparing an emulsion.

Comparative Example 2

First step: Into a 300 mL beaker were put 38 g of diethylene glycol mono n-butyl ether, 9.6 g of propylene glycol and 10.6 g of ion exchange water, and then the solution was stirred to prepare a homogeneous solution. Into the solution was incorporated a solution prepared by dissolving 14 g of sodium carbonate into 94 g of ion exchange water. Thereto were added 35.9 g of the nonionic surfactant (1), 11.9 g of the nonionic surfactant (2) and 1.8 g of the anionic surfactant, and then the components were mixed.

Second step: The mixed liquid prepared in the first step was emulsified by means of a homomixer manufactured by Tokusyu Kika Kogyo Co., Ltd. The emulsification was performed under a condition of 9000 rpm for 5 minutes.

Comparative Example 3

First step: Into a 300 mL beaker were put 0.9 g of polyacrylic acid (1), 38 g of diethylene glycol mono n-butyl ether, 9.5 g of propylene glycol and 10.5 g of ion exchange water, and then the solution was stirred to prepare a homogeneous solution. Into the solution was incorporated a solution prepared by dissolving 14 g of sodium carbonate into 94 g of ion exchange water. Thereto were added 35.5 g of the nonionic surfactant (1), 11.8 g of the nonionic surfactant (2) and 1.8 g of the anionic surfactant, and then the components were mixed.

Second step: The mixed liquid prepared in the first step was emulsified by means of a homomixer manufactured by Tokusyu Kika Kogyo Co., Ltd. The emulsification was performed under a condition of 9000 rpm for 5 minutes.

Comparative Example 4

First step: Into a 300 mL beaker were put 0.9 g of polyethylene glycol (1), 38 g of diethylene glycol mono n-butyl ether, 9.5 g of propylene glycol and 10.5 g of ion exchange water, and then the solution was stirred to prepare a homogeneous solution. Into the solution was incorporated a solution prepared by dissolving 14 g of sodium carbonate into 94 g of ion exchange water. Thereto were added 35.5 g of the nonionic surfactant (1), 11.8 g of the nonionic surfactant (2) and 1.8 g of the anionic surfactant, and then the components were mixed.

Second step: The mixed liquid prepared in the first step was emulsified by means of a homomixer manufactured by Tokusyu Kika Kogyo Co., Ltd. The emulsification was performed under a condition of 9000 rpm for 5 minutes.

(2) Evaluation

About the resultant emulsion compositions, the following evaluations were made. The results are shown in Table 1.

Method for Measuring Electric Conductivity

Into a 200 mL beaker was charged 200 g of an emulsion composition, and the electric conductivity thereof was measured (at 25° C.) using a Kastany ACT pH meter D-24 (electric conductivity electrode cell 9382-10D) manufactured by Horiba Ltd.

[Method for Measuring pH]

Into a 200 mL beaker was charged 200 g of an emulsion composition, and the pH thereof was measured (at 25° C.) using the Kastany ACT pH meter D-24 (electric conductivity electrode cell 9382-10D) manufactured by Horiba Ltd.

[Method for Measuring Viscosity]

Into a 200 mL beaker was charged 200 g of an emulsion composition, and the viscosity thereof was measured at a velocity of 30 r/min (at 25° C.) by means of a Brookfield type viscometer, manufactured by Tokyo Keiki Co., Ltd., using a No. 2 rotor.

[Method for Measuring Degree of Separation by Volume]

A scaled glass sedimentation tube having an inner diameter of 12 mm was charged with each of compositions into a depth of 14 cm, and then sealed. Each of the samples was allowed to stand still and stored at room temperature, 25° C., for one month. After the storage, the thickness x (cm) of a transparent or semitransparent liquid phase separated into the upper layer portion and/or the lower layer portion of the sample was measured. The degree y (%) of separation by volume was obtained according to the following equation (V):

$$y=(x/14)\times 100 \qquad (V)$$

The results were evaluated on the basis of the following criterion:

○: Degree of separation by volume: less than 5%

Δ: 5% or more and less than 10% x: 10% or more

TABLE 1

| | | Example | | | Comparative example | | | |
|---|---|---|---|---|---|---|---|---|
| | | 1 | 2 | 3 | 1 | 2 | 3 | 4 |
| Emulsion composition | Composition (ratio by mass) | | | | | | | |
| | Synthesis polymer solution (1) | 1.1 | 1.1 | | | | | |
| | Synthesis polymer solution (3) | | | 1.1 | | | | |
| | Polyacrylic acid (1) | | | | | | 0.4 | |
| | Polyethylene glycol (1) | | | | | | | 0.4 |
| | Water-soluble organic solvent (1) | 17.6 | 17.6 | 17.6 | 17.7 | 17.7 | 17.6 | 17.6 |
| | Water-soluble organic solvent (2) | 4.1 | 4.1 | 4.1 | 4.4 | 4.4 | 4.4 | 4.4 |
| | Nonionic surfactant (1) | 16.5 | 16.5 | 16.5 | 16.6 | 16.6 | 16.5 | 16.5 |
| | Nonionic surfactant (2) | 5.5 | 5.5 | 5.5 | 5.5 | 5.5 | 5.5 | 5.5 |
| | Anionic surfactant | 0.8 | 0.8 | 0.8 | 0.8 | 0.8 | 0.8 | 0.8 |
| | Sodium carbonate | 6.4 | 6.4 | 6.4 | 6.4 | 6.4 | 6.4 | 6.4 |
| | Ion exchange water | 48.2 | 48.2 | 48.2 | 48.5 | 48.5 | 48.5 | 48.5 |
| | Viscosity (mPa · s) | 397 | 231 | 480 | — | — | — | — |
| | pH | 10.6 | 10.6 | 10.5 | — | — | — | — |

TABLE 1-continued

| | Example | | | Comparative example | | | |
|---|---|---|---|---|---|---|---|
| | 1 | 2 | 3 | 1 | 2 | 3 | 4 |
| Electric conductivity (S/m) | 1.75 | 1.64 | 1.75 | — | — | — | — |
| Degree of separation by volume | ○ | ○ | ○ | X | X | X | X |

Components in Table 1 are described below.
Polyacrylic acid (1): First class reagent, manufactured by Wako Pure Chemicals, Industries, average molecular weight = 25000
Polyethylene glycol (1): First class reagent, manufactured by Wako Pure Chemicals, Industries, average molecular weight = 20000
Nonionic surfactant (1): Emulgen 108 (Kao Corp.)
Nonionic surfactant (2): Emulgen LS-106 (Kao Corp.)
Water-soluble organic solvent (1): Diethylene glycol mono n-butyl ether
Water-soluble organic solvent (2): Propylene glycol
Anionic surfactant: LUNAC L-55 (Kao Corp.)
Synthesis polymer solution (1): Polymer solution synthesized in the same manner as Synthesis Example 1, except for the weight-average molecular weight = 42,000.
Synthesis polymer solution (3): Polymer solution synthesized by Synthesis Example 3 [Optical isotropy]

It was proved by polarization-microscopic observation (at 25° C.) that the emulsion compositions of Examples 1 to 3 in Table 1 were in a stable emulsion state that the surfactant phase was present as droplets in the aqueous solution phase and the surfactant phase was optically isotropic. The polarization-microscopic observation was performed by dropping down one liquid droplet onto a slide glass, covering the glass with a cover glass, and observing the droplet with a MICROPHOT-SA manufactured by Nikon Corp.

Examples 4, 5 and 6

Blending components described in Table 2 were used to yield emulsion compositions according to the method of Example 1. The components in Table 2 are the same as in Table 1, and synthesis polymer dispersion (4) and synthesis polymer solution (7) are the synthesis polymer dispersion (4) synthesized in Synthesis Example 4 and the synthesis polymer solution (7) synthesized in Synthesis Example 9, respectively.

A block polymer of polyethylene glycol and polyacrylic acid (mass ratio: 40/60) is synthesized in the same way as in Synthesis Example 1 described in JP-A 2003-27088, and the polymer can be used as an emulsifier polymer.

TABLE 2

| | | | Example | | |
|---|---|---|---|---|---|
| | | | 4 | 5 | 6 |
| Compounded component (ratio by mass) | Blended components in the first step | Synthesis polymer solution (1) | | 1.8 | |
| | | Synthesis polymer dispersion (4) | 2.2 | | |
| | | Synthesis polymer solution (7) | | | 1.8 |
| | | Water-soluble organic solvent (2) | 4.2 | 3.6 | 3.6 |
| | | Potassium carbonate | 15.6 | 15.6 | 15.6 |
| | | Ion exchange water | 30.0 | 30.7 | 30.7 |
| | | Nonionic surfactant (1) | 18.8 | 18.7 | 18.7 |
| | | Nonionic surfactant (2) | 7.3 | 7.3 | 7.3 |
| | | Anionic surfactant | 1 | 1 | 1 |

A homomixer manufactured by Tokusyu Kika Kogyo Co., Ltd. was used to emulsify the emulsion obtained in the first step in Example 5 (at 3000 rpm for 10 minutes). An optically microscopic photograph of the resultant emulsion shows that the surfactant phase therein was emulsified same as FIG. 1. This shows the solution phase arrounding the surfactant agent phase is continuous. This situation is shown in Table 1. In FIG. 1, images like circles constitute the surfactant phase, and it can be confirmed that an aqueous solution phase is continuously present to surround the surfactant phase.

Reference Example:

Test of Affinity of Polymer Chain

About the polymers used in the above-mentioned Examples and Comparative Examples, the affinities thereof with an aqueous phase and a surfactant phase were checked. That is, from each of the compositions of Examples and Comparative Examples, a composition wherein the polymer therein was removed was prepared. The composition was separated into an aqueous solution phase (lower phase) containing the specific electrolytic salt and a surfactant phase (upper phase) containing the specific nonionic surfactant phase.

About each of the polymers of Examples and Comparative Examples, a polymer having essentially the same structure as the polymer chain thereof and having the following weight-average average molecular weight, or a monomer having the polymer chain was incorporated into the subject phase so as to have a concentration of 5% by mass. The resultant mixture was stirred at 60° C. for 30 minutes, and the temperature thereof was returned to room temperature (25° C). The resultant was allowed to stand still for one hour, and subsequently the affinity was checked. In Table 3, ○ means that the polymer or the monomer was dissolved, and x means that the polymer or monomer was not dissolved.

TABLE 3

| Polymer or monomer | Phases | |
|---|---|---|
| | Aqueous solution phase | Surfactant phase |
| Polyacrylic acid | ○ | X |
| Polymethacrylic acid solution | ○ | X |
| Polyethylene glycol (mole number of EO added: 90) monomethacrylate | X | ○ |
| Lauryl methacrylate | X | ○ |

Polyacrylic acid: The same as in Table 1
Polymethacrylic acid solution: Aqueous polymethacrylic acid solution obtained in Synthesis Example 7
Polyethylene glycol (mole number of EO added: 90) monomethacrylate: NK-ester M-900G, manufactured by Shin-Nakamura Chemical Co., Ltd.
Lauryl methacrylate: Exceparl L-MA, manufactured by Kao Corp.

(1) Preparation of Liquid detergent Compositions

Example 11

First step: Into a 300 mL beaker were put 2.3 g of the synthesis polymer solution (1), 38 g of diethylene glycol mono n-butyl ether, 8.8 g of propylene glycol and 9.9 g of ion exchange water, and then the solution was stirred to prepare a homogeneous solution. Into the solution was incorporated a solution prepared by dissolving 14 g of sodium carbonate into 94 g of ion exchange water. The resultant solution was stirred to yield a homogeneous solution.

Second step: Into the homogeneous solution obtained in the first step was incorporated a homogeneous solution wherein 35.8 g of the nonionic surfactant (1), 11.8 g of the nonionic surfactant (2) and 1.8 g of the anionic surfactant were mixed, so as to yield an emulsion.

Third step: The emulsion yielded in the second step was emulsified by means of a homomixer manufactured by Tokusyu Kika Kogyo Co., Ltd. The emulsification was performed under a condition of 9000 rpm for 5 minutes. The resultant emulsion was homogeneous. The emulsion was measured by means of a B type viscometer (rotor: No. 2, number of rotations: 60 rpm). As a result, the viscosity was 70 mPa·s. (A digital electric conductivity meter CM-40V manufactured by Toa Denpa Kogyo Co., Ltd. was used to measure the electric conductivity thereof (at 25° C.). The electric conductivity was 1.5 S/m.)

Fourth step: Into the emulsion obtained in the third step was incorporated 32.4 g of a zeolite (1), and then the homomixer was used to stir the solution (at 6000 rpm for 5 minutes), thereby yielding a liquid detergent composition. A portion of this liquid detergent composition was collected, and diluted with water. The particle size thereof was measured with a particle size distribution measuring device (LA-910, manufactured by Horiba Ltd., relative refractive index: 1.2, temperature: 20° C.). As a result, the average particle size was 4.5 μm. The liquid detergent composition was measured with the B type viscometer (rotor: No. 2, number of rotations: 30 rpm). As.a result, the viscosity was 740 mPa Example 12

First step: Into a 300 mL beaker were put 4.4 g of the synthesis polymer solution (1) and 9.2 g of propylene glycol, and then the solution was stirred to prepare a homogeneous solution. Into the solution was incorporated a solution prepared by dissolving 39 g of potassium carbonate into 77 g of ion exchange water. The resultant solution was stirred to yield a homogeneous solution.

Second step: Into the homogeneous solution obtained in the first step was incorporated a homogeneous solution wherein 47 g of the nonionic surfactant (1), 18 g of the nonionic surfactant (2) and 2.6 g of the anionic surfactant were mixed, so as to yield an emulsion.

Third step: The emulsion yielded in the second step was emulsified by means of a homomixer manufactured by Tokusyu Kika Kogyo Co., Ltd. The emulsification was performed under a condition of 9000 rpm for 5 minutes. The resultant emulsion was homogeneous. The emulsion was measured by means of a Brookfield type viscometer (rotor: No. 2, number of rotations: 60 rpm). As a result, the viscosity was 68 mpa·s. (A digital electric conductivity meter CM-40V manufactured by Toa Denpa Kogyo Co., Ltd. was used to measure the electric conductivity (at 25° C.). The electric conductivity was 3.4 S/m.)

Fourth step: Into the emulsion obtained in the third step was incorporated 52 g of the zeolite (1), and then the homomixer was used to stir the solution (at 8000 rpm for 5 minutes), thereby yielded a liquid detergent composition. A portion of this liquid detergent composition was collected, and diluted with water. The particle size thereof was measured with the particle size distribution measuring device (LA-910, manufactured by Horiba Ltd., relative index of refraction: 1.2, temperature: 20° C.). As a result, the average particle size was 4.5 μm. The liquid detergent composition was measured with the Brookfield type viscometer (rotor: No. 2, number of rotations: 30 rpm). As a result, the viscosity was 460 mPa□s.

Examples 13, 14, 15, 16, 17, 18 and 19

Blend amounts shown in Table 4 were used to yield liquid detergent compositions according to the same steps as in Example 12.

In the third step in Example 18, the homomixer manufactured by Tokusyu Kika Kogyo Co., Ltd. was used to emulsify the emulsion obtained in the step 2 (at 3000 rpm for 10 minutes). An optically microscopic photograph of the resultant emulsion demonstrates that the surfactant phase therein was emulsified as shown in FIG. 1. This confirms that the aqueous solution phase is continuously present, surrounding the surfactant phase.

(2) Evaluation

About the resultant liquid detergent compositions, the following evaluations were made. The results are shown in Table 4.

(Degree of Separation by Volume)

A scaled glass sedimentation tube was charged with each of liquid detergent compositions into a depth of 30 cm, and then sealed. Each of the samples was allowed to stand still and stored at room temperature, 25° C., for one month. After the storage, the boundary between a transparent liquid phase and a solid dispersed phase of the sample was determined with the naked eye, and then the thickness x (cm) of the transparent liquid phase generated in the upper phase portion by phase separation was measured. The degree y (%) of separation by volume was obtained according to the following equation (V):

$$y=(x/30)\times 100 \qquad (V)$$

The results were evaluated on the basis of the following criterion:

○: Degree of separation by volume=less than 5%

Δ: Degree of separation by volume=5% or more and less than 10% x: Degree of separation by volume=10% or more (Method for Measuring Viscosity)

Into a 200 mL beaker was charged 200 g of a liquid detergent composition, and the viscosity thereof was measured (at 25° C.) with a Brookfield type viscometer, manufactured by Tokyo Keiki Co., Ltd. in such a manner that a No. 2 (or No. 3) rotor was set into a velocity condition of 6 to 60 r/min in accordance with the viscosity.

(Method for Measuring pH]

Into a 200 mL beaker was charged 200 g of a liquid detergent composition, and the pH thereof was measured (at 20° C.) using a pH meter D-24 manufactured by Horiba Ltd. The pH in Example 18 was 11.

(Viscosity Increase Test)

Into a 50 mL sample tube was charged 40 g of a liquid detergent composition, and then 2 g of ion exchange water was added thereto. The tube was covered with a lid, and shaken by hand. Thereafter, the viscosity thereof was measured (at 25° C.) with the Brookfield type viscometer, manufactured by Tokyo Keiki Co., Ltd. in such a manner that the used No. 2 or No. 3 rotor was set into a velocity condition of 60 r/min. Thereafter, ion exchange water was added thereto 2 g by 2 g until the amount thereof totaled to 10 g. Whenever the addition was performed, the same measurement as above was made.

It is noted in results of Viscosity Increase Test of example 12 and 18 that any large change of viscosity was not observed and the viscosity after the test was the same as or less than the viscosity before the test.

Comparative Example 11

Into a liquid wherein 4.44 g of the synthesis polymer dispersion (4) obtained in Synthesis Example (4) and 69.56 g of ion exchange water were incorporated 7 g of sodium tetraborate, 10 g of glycerol and 12 g of sodium carbonate. The components were mixed under stirring. To the resultant cloudy liquid were added 30.8 g of the nonionic surfactant (1), 41 g of sodium alkyl (having 12 carbon atoms) benzenesulfonate (Neopelex No. 6, manufactured by Kao Corp.), 15 g of sodium oleate and 10.2 g of sodium laurate. A homomixer was used to stir the solution (at 8000 rpm for 5 minutes), thereby yielding an emulsion. The emulsion became more viscous to turn into a gel form.

Comparative Example 12

The same blending as in Example 12 was carried out except that no polymer solution was added. After the end of the third step, the resultant was allowed to stand still for 30 minutes to be separated into the upper and lower phases.

TABLE 4

| | | Example | | | | | | | | |
|---|---|---|---|---|---|---|---|---|---|---|
| | | 11 | 12 | 13 | 14 | 15 | 16 | 17 | 18 | 19 |
| Blended components (mass ratio) | Blended component in the first step | | | | | | | | | |
| | Synthesis polymer solution (1) | 0.9 | 1.8 | | | | | | 1.8 | |
| | Synthesis polymer solution (2) | | | 2.0 | | | | | | |
| | Synthesis polymer solution (3) | | | | 2.0 | | | | | |
| | Synthesis polymer dispersion (4) | | | | | 2.2 | | | | |
| | Synthesis polymer dispersion (5) | | | | | | 2.2 | | | |
| | Synthesis polymer dispersion (6) | | | | | | | 2.5 | | |
| | Synthesis polymer solution (7) | | | | | | | | | 2.2 |
| | Water-soluble organic solvent (1) | 15.5 | | | | | | | | |
| | Water-soluble organic solvent (2) | 3.6 | 3.7 | 3.6 | 3.6 | 4.2 | 3.6 | 3.2 | 3.6 | 3.6 |
| | Sodium carbonate | 5.6 | | | | | | | | |
| | Potassium carbonate | | 15.7 | 15.7 | 15.7 | 15.6 | 15.6 | 15.6 | 15.6 | 15.6 |
| | Ion exchanged water | 42.1 | 30.8 | 30.7 | 30.7 | 30.0 | 30.7 | 30.8 | 30.7 | 30.7 |
| | Blended component in the second step | | | | | | | | | |
| | Nonionic surfactant (1) | 14.4 | 18.8 | 18.8 | 18.8 | 18.8 | 18.8 | 18.8 | 18.7 | 18.8 |
| | Nonionic surfactant (2) | 4.8 | 7.3 | 7.3 | 7.3 | 7.3 | 7.3 | 7.3 | 7.3 | 7.3 |
| | Anionic surfactant | 0.7 | 1 | 1 | 1 | 1 | 1 | 1 | 1 | 1 |
| | Blended component in the fourth step | | | | | | | | | |
| | Inorganic builder particle Zeolite | 13.1 | 20.9 | 20.1 | 20.11 | 20.8 | 20.9 | 20.8 | 20.8 | 20.9 |
| | Perfume | | | | | | | | 0.3 | |
| | Fluorescent dye | | | | | | | | 0.1 | |

TABLE 4-continued

| | Example | | | | | | | | |
|---|---|---|---|---|---|---|---|---|---|
| | 11 | 12 | 13 | 14 | 15 | 16 | 17 | 18 | 19 |
| Degree of separation by volume | ○ | ○ | ○ | ○ | ○ | ○ | ○ | ○ | ○ |
| Viscosity (mPa · s/25° C.) | 740 | 460 | — | 746 | 742 | 1300 | 875 | 462 | — |

Components in Table 4 are as follows:
Nonionic surfactant (1): Emulgen 108 (Kao Corp.)
Nonionic surfactant (2): Emulgen LS-106 (Kao Corp.)
Water-soluble organic solvent (1): Diethylene glycol mono butyl ether
Water-soluble organic solvent (2): Propylene glycol
Anionic surfactant: Diphatic acid having an alkyl having 10 to 14 carbon atoms
Synthesis polymer solution (1): Polymer solution synthesized by Synthesis Example 1
Synthesis polymer solution (2): Polymer solution synthesized by Synthesis Example 2
Synthesis polymer solution (3): Polymer solution synthesized by Synthesis Example 3
Synthesis polymer dispersion (4): Polymer solution synthesized by Synthesis Example 4
Synthesis polymer dispersion (5): Polymer dispersion synthesized by Synthesis Example 5
Synthesis polymer dispersion (6): Polymer dispersion synthesized by Synthesis Example 6
Synthesis polymer solution (7): Polymer solution synthesized by Synthesis Example 9
Zeolite: Type A zeolite, manufactured by Zeo Builder Co.
Fluorescent dye: Chino Pearl CBS-X, manufactured by Chiba Specialty Chemicals Co.

A block polymer of polyethylene glycol and polyacrylic acid (mass ratio: 40/60) is synthesized in the same way as in Synthesis Example 1 described in JP-A 2003-27088, and the polymer can be used as an emulsifier polymer.

The liquid detergent compositions of Examples in Table 4 are suitable for textiles, and all of the compositions have sufficient detergency against organic stains or inorganic stains adhered to textiles, in particular, clothes when they are usually used. Example 12 and Comparative Example 11 were observed with the following polarization microscope.

(Polarization-Microscopic Observation)

The emulsion obtained in the third step in Example 12 was observed with a polarization microscope by a method described below. As a result, it was proved that the emulsion was optically isotropic. The emulsion obtained in Comparative Example 11 was observed with the polarization microscope in the same way. As a result, it was proved that the emulsion was optically anisotropic.

In the polarization-microscopic observation, one liquid droplet was dropped on a slide glass, and the glass was covered with a cover glass. The observation was made (at 25° C.) with a polarization microscope, MICROPHOT-SA, manufactured by Nikon Corp.

[Test of Affinity of Each Segment]

Reference Example:

Test of Affinity of Polymer Chain

About the emulsifier polymers used in Examples 14 and 15, the affinities of the polymer chain thereof with an aqueous phase and a surfactant phase were checked. That is, from each of the compositions of Examples 14 and 15, a composition wherein the emulsifier polymer and the inorganic builder particles were removed was prepared. The composition was separated into an aqueous solution phase (lower phase) containing the specific electrolytic salt and a surfactant phase (upper phase) containing the nonionic surfactant phase.

About each of the polymers of Examples 14 and 15, a polymer having essentially the same structure as the polymer chain thereof and having the following weight-average molecular weight, or a monomer having the polymer chain was incorporated into the subject phase so as to have a concentration of 5% by mass. The resultant mixture was stirred at 60° C. for 30 minutes, and the temperature thereof was returned to room temperature (25° C.). The resultant mixture was allowed to stand still for one hour, and subsequently the affinity of the polymer chain was checked on the basis of solubility. In Table 5, ○ means that the polymer or the monomer was dissolved, and x means that the polymer or monomer was not dissolved.

TABLE 5

| | Phases | |
|---|---|---|
| Polymer or Monomer | Aqueous solution phase | Surfactant phase |
| Polyacrylic acid | ○ | X |
| Polymethacrylic acid solution | ○ | X |
| Polyethylene glycol (mole number of EO added: 90) monomethacrylate | X | ○ |
| Lauryl methacrylate | X | ○ |

Components in Table 5 are as follows.
Polyacrylic acid: First class reagent, manufactured by Wako Pure Chemicals, Industries, average molecular weight = 25000
Polymethacrylic acid solution: Aqueous polymethacrylic acid solution obtained in Synthesis Example 7
Polyethylene glycol (mole number of EO added: 90) monomethacrylate: NK-ester M-900G, manufactured by Shin-Nakamura Chemical Co., Ltd.
Lauryl methacrylate: Exceparl L-MA, manufactured by Kao Corp.
Aqueous solution phase and Surfactant phase: Respective components having the same composition as in Example 14 except that the polymer solution and zeolite were removed were mixed, and then the mixture was allowed to stand still for 24 hours to be separated into two layers. The upper phase thereof was a surfactant phase containing the nonionic surfactant, and the lower phase was an aqueous solution phase containing the electrolytic salt.

The invention claimed is:

1. An emulsion composition, comprising:

an optically isotropic surfactant phase comprising a nonionic surfactant (hereinafter the phase being referred to as The surfactant phase) in an amount of 10% or more by mass, wherein said surfactant phase is present as droplets ranging from 0.1 to 10 μm in an aqueous solution phase, and an aqueous solution phase comprising an electrolytic salt (hereinafter the phase being referred to as the aqueous solution phase), the amount of the salt being such an amount that the aqueous solution phase is incompatible with the surfactant phase, wherein the water content of the entire composition is 20% or more by mass and the electrolytic salt content is from 4 to 32% by mass, wherein the surfactant phase and the aqueous solution phase are stabilized with an emulsifier polymer selected from the group consisting of:

(1) a copolymer containing an ester of a polyalkylene glycol and a vinyl monomer having a carboxyl group or a salt thereof; and (meth)acrylic acid or a salt thereof (hereinafter being referred to as emulsifier polymer (1));

(2) a copolymer containing an ether of polyalkylene glycol having a reactive unsaturated group; and (meth) acrylic acid or a salt thereof (hereinafter being referred to as emulsifier polymer (2)); and (3) a copolymer containing (meth)acrylic acid esters having a saturated alkyl or aralkyl group having 9 to 30 carbon atoms; and (meth)acrylic acid or a salt thereof (hereinafter being referred to as emulsifier polymer (3)).

2. The emulsion composition according to claim 1, which further comprises a water-soluble organic solvent which comprises a hydroxyl group.

3. The emulsion composition according to claim 1, wherein the emulsifier polymer is a block polymer or a graft polymer.

4. The emulsion composition according to claim 1, wherein the electrolytic salt is a carbonate of an alkali metal.

5. The emulsion composition according to claim 1, wherein the nonionic surfactant has an HLB of 9 to 16.

6. The emulsion composition according to claim 1, which has a viscosity (at 25° C.) of 3000 mPa·s or less.

7. The emulsion composition according to claim 1, which is for a detergent.

8. A liquid detergent composition comprising the emulsion composition according to claim 1 and inorganic builder particles dispersed in the emulsion composition, wherein the mass ratio of the emulsifier polymer/the inorganic builder particles is from 1/80 to 1/4.

9. The liquid detergent composition according to claim 8, wherein the inorganic builder particles comprise an aluminosilicate compound.

10. The liquid detergent composition according to claim 8 or 9, which has a viscosity (at 25° C.) of 3000 mPas·or less.

11. A process for producing the liquid detergent composition according to claim 8 or 9, comprising the step of mixing an emulsion composition comprising the emulsifier polymer, the electrolytic salt, the nonionic surfactant and water with inorganic builder particles.

12. The emulsion composition according to claim 1, wherein the emulsifier polymer is a copolymer containing an ester of a polyalkylene glycol and (meth)acrylic acid or a salt thereof; and (meth)acrylic acid or a salt thereof.

13. A emulsion composition according to claim 1, wherein the emulsifier polymer (1) is a copolymer containing an ester of a polyalkylene glycol and a vinyl monomer having a carboxyl group or a salt thereof; and (meth)acrylic acid or a salt thereof, wherein the hydroxyl group of the polyakylene glycol is substituted by an alkyl group having 1 to 30 carbon atoms.

14. An emulsion composition according to claim 1, wherein the emulsifier polymer is emulsifier polymer (1).

15. An emulsion composition according to claim 1, wherein the emulsifier polymer is emulsifier polymer (2).

16. An emulsion composition according to claim 1, wherein the emulsifier polymer is emulsifier polymer (3).

17. An emulsion composition according to claim 1, wherein the water content of the entire composition is 30% or more by mass.

18. An emulsion composition according to claim 1, wherein the emulsifier polymer (1) is a copolymer containing polyethylene glycol mono(meth)acrylate and (meth) acrylic acid or a salt thereof.

19. An emulsion composition according to claim 1, wherein the emulsifier polymer (2) is a copolymer containing polyethylene glycol allyl ether and (meth)acrylic acid or a salt thereof.

* * * * *